US005836393A

United States Patent [19]

Johnson

[11] Patent Number: 5,836,393

[45] Date of Patent: Nov. 17, 1998

[54] PULSE GENERATOR FOR OIL WELL AND METHOD OF STIMULATING THE FLOW OF LIQUID

[76] Inventor: Howard E. Johnson, 3765 Bozeman Lake Rd., Kennesaw, Ga. 30144

[21] Appl. No.: 820,536

[22] Filed: Mar. 19, 1997

[51] Int. Cl.[6] ..... E21B 43/26

[52] U.S. Cl. ..... 166/308; 166/177.5

[58] Field of Search ..... 166/249, 299, 166/305.1, 308, 63, 177.5, 177.6; 299/16

[56] References Cited

U.S. PATENT DOCUMENTS

| | | | |
|---|---|---|---|
| 4,081,031 | 3/1978 | Mohaupt | 166/299 |
| 5,205,360 | 4/1993 | Price | 166/63 X |
| 5,297,631 | 3/1994 | Gipson | 166/299 |
| 5,579,845 | 12/1996 | Jansen et al. | 166/299 |

OTHER PUBLICATIONS

Bolt Technology Corporation brochure: Bolt Land Air Gun at Work Around the World (1987).

*Primary Examiner*—David J. Bagnell
*Attorney, Agent, or Firm*—Thomas, Kayden, Horstemeyer & Risley

[57] ABSTRACT

This invention relates to oil well production, particularly to a method and apparatus for downhole stimulation of oil production from a well by generating cyclic shock waves in and around the wellbore.

High pressure air passes through gas supply conduit (16), downwardly through pilot passage (54) of pilot valve (48) into internal piston valve chamber (58) and high pressure chamber (30). When the pressure in chambers (58) and (30) exceed 80% of the line pressure from supply conduit (16), pilot valve (48) shifts vertically, exposing the upper end of piston valve (56) to high pressure, and thereby urging the piston valve downwardly to open the high pressure chambers (58) and (30) into the low pressure chamber (32), thus creating an abrupt charge of gas into the well. The movement of line pressure through high pressure passage (78) to a position behind the annular shoulder (82) of the piston valve (56) causes the piston valve to return to its start position, and the differential pressure across pilot valve (48) causes it to move back to its start position.

6 Claims, 2 Drawing Sheets

PULSE GENERATOR FOR OIL WELL AND METHOD OF STIMULATING THE FLOW OF LIQUID

BACKGROUND OF THE INVENTION

Various techniques have been devised for stimulating the flow of oil in an oil well, such as the use of solvents or acids injected downhole into a production zone so as to break up and flow through the perforations in the surrounding formations. Solvents and acids tend to dissolve and dilute contaminants, such as scale, bitumen, sediment and the like which may have plugged the slots of the downhole casing, thereby allowing the oil in the production zone to more easily flow into the casing and be brought to the surface.

Another technique is to use a propellant which is ignited by an ignition device which propels at high velocity and short duration a flow of fluid through the wellbore perforations. After the ignition, there is cooling and contraction of the gas which tends to create an implosion and flow of oil into the wellbore from about the obstructions in the formation.

Another prior art technique is to use an air gun, such as the Bolt brand air gun which is moved downhole and is electrically fired so as to generate a high pressure surge of air outwardly into the production zone. Again, the surge of air tends to disturb the formation, opening the perforations between obstructions, and the following implosion also disturbs the obstructions, thereby tending to open the flow of oil to the well casing. The use of electrically actuated air guns to generate high pressure air pulses requires a supply of high pressure air and electrical connection to the air gun at a substantial distance from the ground surface.

While the foregoing techniques are part of the prior art, the surges of high pressure and the use of acid have not always provided the desired results.

SUMMARY OF THE INVENTION

Briefly described, the present invention provides a method and apparatus for stimulating the production zone of an oil well by the provision of a rapid series of high pressure shock waves generated by a downhole pulse wave generator which is actuated by the high pressure gas which is used to form the series of pulses.

The pulse wave generator uses a technique and a unique pulse wave generator device designed to stimulate fluid production in the well by micro-fracturing the formation and by breaking up and removing obstructions to flow, such as scale, bitumen, sediment, sulfide and sulfate deposits, in the wellbore and in the wellbore perforations, and in the flow channels of the producing formation. The pulse wave generator device or gas expulsion tool produces two types of pulse waves in the well system resulting from repetitive controlled explosive releases of compressed gas: (1) high amplitude low frequency, under 50 Hz, pulses or shock waves are generated in the wellbore fluid in response to rapidly opening a chamber containing high pressure gas, with the pulse traveling at the speed of sound through the liquid medium; and (2) a secondary oscillatory pulse wave is generated by the expanding and collapsing of the gas bubble in the liquid of the well.

In order to be most effective, the pulse wave generator should be fired when it is fully submerged under the liquid of the production zone since the relatively incompressible properties of liquid transmit the pulse waves much more efficiently than the gas. The device also should be located as closely as possible to the well production zone which is to be stimulated to minimize attenuation of the pulses.

The cyclic shock waves which are in the form of compression and expansion waves fatigue, break down and displace the materials which are plugging up the flow channels of the formation. The oscillatory waves create an inflow-outflow motion through the perforations and deep into the formation, thus helping to transport the debris to the wellbore where it can be pumped out of the well. Differential pressure at which the pulse wave generator is operated, i.e. the supply line pressure minus the wellbore pressure, should be higher than the fracture pressure of the formation in order to induce micro-fracturing in the production formation. Once the near wellbore zone has been micro-fractured and obstructions to flow have been circulated out of the well, the permeability of the producing formation in the region of the near wellbore is significantly increased, thus allowing oil and gas to be recovered much more rapidly and efficiently.

The pulse wave generator includes a high pressure gas storage chamber and a rapidly opening valve mechanism which has only two moving parts, and elongated piston valve, and an elongated pilot valve. The amplitude and the frequency of the pressure pulse generated by the pulse wave generator is determined by the geometry and other mechanical parameters of the pulse wave generator. The device does not require an electrical control, and all that is needed for a well treatment with this device is a high pressure gas supply line and a means to move the pulse wave generator up and down in the well in the near proximity of the producing zone. There is no need for electrical or other types of control lines.

The rate of firing, typically one discharge every three seconds, is determined by the size of the orifice supplying the high pressure gas to the gas storage chamber of the pulse wave generator. This three second interval produces enough time for the created air bubble to move away from the discharge ports of the generator, thus ensuring that the generator fires directly into the liquid instead of into the gas. Firing into the liquid assures maximum distribution of the pulse, whereas firing into gas means that the pulse would be partially absorbed by the surrounding gas.

The pressure at which the pulse generator fires is a function of the line pressure leading downwardly to the pulse wave generator. Typically, the pulse generator is preset to fire automatically as the internal chamber pressure reaches 80% of the gas supply line pressure. For example, if the supply line pressure is 3000 psi, the pulse generator will discharge when the chamber pressure reaches 2400 psi. Thus, by simply controlling the line pressure from the surface, the operator can easily vary the power of the pulse generator as desired.

Mechanics of operation of the pulse generator are quite simple. As the high pressure gas is supplied to the inlet of the device, a sealed chamber formed by an outer housing and a main piston valve begins to pressurize. As the increasing pressure in the chamber approaches 80% of the supply line pressure, a small trigger piston or pilot valve in the top end of the main piston valve becomes "un-balanced" and disengages itself from the main piston valve. The large surface area of the head of the main piston valve is now suddenly exposed to the high pressure in the formerly sealed piston chamber, causing the main piston valve to accelerate downwardly and "fire", rapidly venting the chamber to the lower wellbore pressure. This explosive release of energy in the form of compressed gas creates a pulse wave.

With only two moving parts, the tool is very reliable and will operate trouble free for extended periods without service. The typical tool is designed to operate at differential pressures to 5000 psi and tolerate bottomhole temperatures of 500° F. The pulse generator also can be manufactured in a variety of sizes, but for most oil and gas applications, a size of 1.688 inches diameter is considered to be optimal.

The amplitude of the pressure pulse is determined by the pressure differential, the rise time and the release rate. The rise time of the pressure pulse typically is less than 18 milliseconds. The total energy is determined by the pressure differential, release rate, and the event duration (volume).

The principal advantages of the device are:

1. It is very portable and can be easily lowered into and retrieved from the well by any appropriate means;
2. It requires only a gas source to operate; no electrical or other control means are required;
3. It is inexpensive to build and to maintain;
4. It can be manufactured in small sizes to perform stimulation "through tubing";
5. Gas consumption is very low, therefore it is inexpensive to operate; and
6. No special skills are required for the operating personnel.

The preferred method of delivery of tool into the well is by means of a coiled tubing unit, an apparatus commonly utilized in oil well service operations. The coiled tubing unit also provides the function of supplying the high pressure gas to the pulse wave generator. Under certain conditions, it may be economically advantageous to place a flexible high pressure hose or tube inside of the coil tubing to supply the high pressure gas to the pulse wave generator. Since the tool consumes only a small volume of gas, a small diameter high pressure supply line could extend the life of the coil tubing which, because of its larger diameter, is more susceptible to fatigue from the combined effects of tension, bending, and internal pressure. One example when this "supply line within the coil tubing" approach might be desirable would be when it is necessary to accommodate the very high pressure requirements of extremely deep wells. Although any compressed gas may be used, nitrogen usually is the gas of choice because it does not support combustion, is relatively inert, is inexpensive, and is easily transported and pumped at high pressures in its liquid state by means of "nitrogen pumper" trucks.

Applicant has discovered that the pulse wave shape is important with respect to the cleaning of the well and stimulating oil or other liquid recovery. The shape of the pulse will determine the penetrating power of the pulse. If the main frequency spectrum of the pulse is at or below 50 Hz, the pulse wave can travel for long distances through the earth with minimum attenuation. This low frequency spectrum also is in the range of the natural frequencies of the materials which are "plugging up" the formation about the wellbore and impeding the flow of oil to the wellbore. The generation of gas "explosions" at the natural frequencies of the subterranean earth formations that are impeding the flow to the well will cause the impeding materials to vibrate and fatigue, thus breaking them up so that they may be removed by the flow of liquid through the earth formation. In contrast, if the main frequency spectrum of the pulses generated by the gas expulsion tool consists of a high percentage of high frequency waves, the pulses tend to become dissipated a short distance from the gas expulsion tool. The lower, more desirable frequency spectrum for the gas pulses is determined by the duration of the pulse, which applicant believes should be greater than 20 milliseconds. Factors which control the amplitude and duration of the pulse are the rise time of the pressure pulse, the volume of the gas, and the rate at which the gas is allowed to escape. These parameters can be controlled by the mechanical design of the gas expulsion tool.

If the rise time of the pressure pulse is excessively long, the "shock wave" is lowered and typically only an oscillatory wave is generated, which, though it would be of the desired "low frequency spectrum", it would not provide the effective cleaning desired by applicant.

Applicant's best stimulation occurs when the pulse creates a pressure in the formation which exceeds the fracture pressure of the formation, thereby micro fracturing the formation. In most oil-bearing formations, the typical fracture gradient is generally considered to be 0.7 psi per foot of overburden. For example, a well which is 5,000 feet deep will have a fracture pressure of 3500 psi. This means that if the pressure is raised to 3500 psi at the earth formation which is to be fractured, the fracturing will occur in the formation. However, if a water column exists in the well at, for example 4,000 feet above the producing zone and exerts a pressure of 1,731 psi at the earth formation which is to be fractured, the formation will fracture if the pressure pulse generated by the pressure expulsion tool exceeds 1769 psi, which is 3500 psi minus 1,731 psi.

However, it is well known that the formation will fracture when the pressure exceeds the fracture pressure in classical fracturing operations. This fracture pressure is achieved by pumping fluids downhole at a rate faster than the formation can take the fluid. This pressure increase from pumping operations is uniform and relatively slow, and it is also not cyclic. However, it is also well known that fracturing will occur at significantly lower pressures than the static fracturing pressure of the formation if the pressure is applied in a rapid and cyclic manner. Since the pulse wave generator applies the pressure virtually instantaneously (18 milliseconds) and repeatedly (every 3 seconds), it may not be necessary to achieve the "static" fracturing pressure with the pressure pulse in order to micro-fracture the formation. It is generally accepted that, in most materials, structural failure will occur at 50% of the status load or less when they are loaded dynamically. Cyclic fatigue of the formation will also contribute to reducing the fracturing pressure required although this factor is difficult to quantify. The applicant believes that most formations will fracture at 50% or less of the calculated fracturing pressure when the formation is subjected to these "instantaneous" and "successive" high pressure pulses from the invention. Therefore, the invention may be operated at lower pressures than the previous example to achieve excellent stimulation results.

Thus, it is an object of this invention to provide an improved pulse wave generator for down hole wells for the purpose of increasing the flow of liquid in the well.

Another object of this invention is to provide an improved downhole pulse wave generator that operates without electrical controls to fire a rapid series of air pulses that form shock waves in the production zone of a well so as to break up the obstructions to the flow of liquid to the well and/or microfracture the formation, thus increasing the permeability of the formation.

Other objects, features and advantages of this invention will become apparent upon reading the following specification, when taken in conjunction with the accompanying drawings.

DETAILED DESCRIPTION

Figure 1:
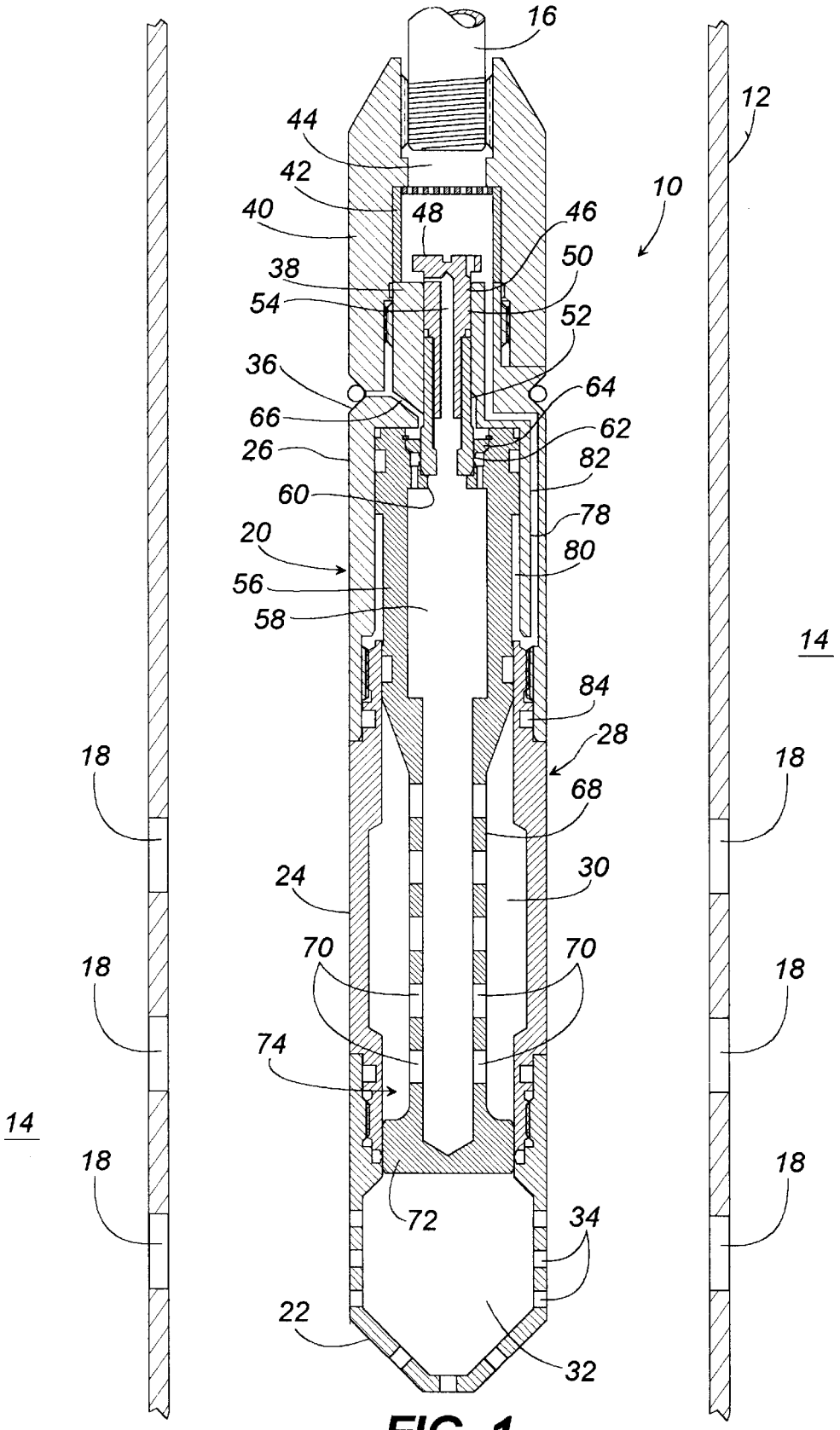
FIG. 1 is a side cross-sectional view of the pulse wave generator, shown in a well casing.

Referring now in more detail to the drawings, in which like numeral indicate like parts throughout the several views, FIG. 1 illustrates the pulse wave generator 10 located in a well casing 12 at the production zone 14 of a well, with the pulse wave generator connected at its upper end to a gas supply conduit 16 that is the lower end of a coiled tubing unit at the surface of the well. Openings 18 are formed in the well casing 12 for the ingress of oil from the production zone 14.

Pulse wave generator 10 includes a housing 20 that is formed in three sections, the lower nose section 22, the intermediate cylindrical section 24, and the upper cylindrical section 26. The intermediate cylindrical section 24 and upper cylindrical section 26 together form an elongated high pressure housing 28 which defines an elongated high pressure chamber 30, while the lower nose section 22 defines internal low pressure chamber 32 which freely communicates with the interior of the well casing 12 through gas exhaust ports 34.

The upper end of upper cylindrical section 26 is reduced in diameter and includes annular sloped shoulder 36 and a cylindrical connector neck 38. Connector collar 40 is threadedly mounted at its lower end to connector neck 38, and is threadedly mounted at its upper end to gas supply conduit 16. Strainer 42 is positioned in the internal passage 44 of the connector collar 40.

Figure 2:
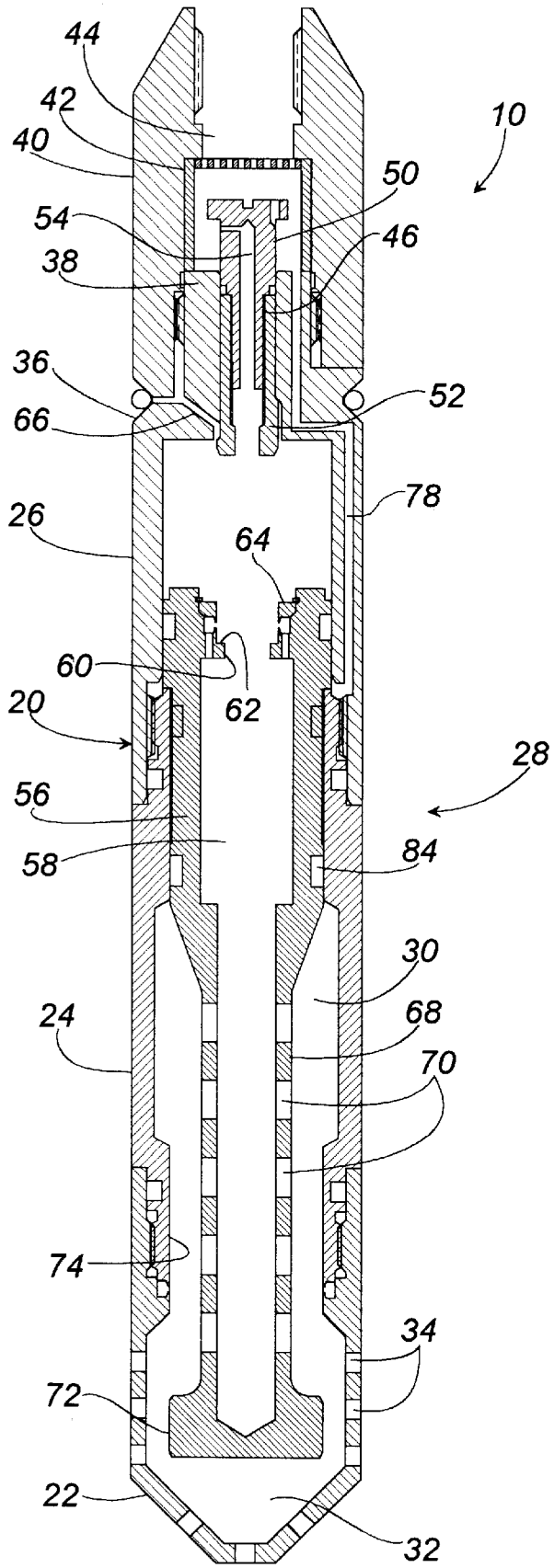
FIG. 2 is a side cross-sectional view of the pulse wave generator, similar to FIG. 1, but showing the pilot valve and piston valve in their open positions.

Neck 38 of upper cylindrical section 26 of housing 20 defines a pilot valve opening 46 that communicates between internal passage 44 of connector collar 40 and elongated high pressure chamber 30 of the high pressure housing 28. Pilot valve 48 is slidably positioned in pilot valve opening 46 and is formed in two sections which are telescopically connected together, the upper section 50 and the lower section 52. The upper and lower sections 50 and 52 are telescopically connected and together form a gas bleed passage 54 that freely communicates between gas supply conduit 16 and the internal passage 44 of collar 40 at its upper end, and high pressure chamber 30 at its lower end. The pilot valve 48 has larger effective pressure surfaces exposed to high pressure chamber 30 than to internal passage 44 of connector collar 40. Therefore, should the pressures on opposite sides of pilot valve 48 become equal, the pilot valve will be thrust upwardly to the position as illustrated in FIG. 2. Further, these effective pressure surfaces facing upwardly and downwardly are proportioned so that if the pressure in the high pressure chamber 30 exceeds 80% of the pressure in the gas supply conduit 16 and internal passage 44 of the connector collar 40, the pilot valve 48 will be urged upwardly.

Elongated piston valve 56 is positioned in and is reciprocatable along the length of high pressure chamber 30 from the up, closed position shown in FIG. 1 to the down, open position shown in FIG. 2. Piston valve 56 defines an internal piston chamber 58 that opens through the upper end of piston 56 at pilot valve opening 60. Pilot valve seat 62 of piston valve 56 engages the lower end of pilot valve 48 and forms a seal between the pilot valve and the piston valve. O-ring seal 64 which is carried internally of piston valve 56 slidably seals against the lower end of pilot valve 48, also forming a pilot valve seat. Vent 66 extends from behind O-ring 64 to the atmosphere of well casing 12, so as to allow freedom of movement of the pilot valve with respect to the piston valve.

The external surfaces of the upper portion of the piston valve 56 are sized and shaped to slidably engage the internal surfaces of the high pressure housing 28, guiding the piston valve along the length of the high pressure chamber 30. The intermediate portion 68 of piston valve 56 is of reduced diameter, and gas ports 70 freely communicate between the internal piston chamber 58 and the high pressure chamber 30 of the housing. The lower end portion of the piston valve 56 includes a valve head 72 which is of larger breadth than the intermediate portion of the piston valve, and which slidably engages a cylindrical valve seat 74 that projects inwardly of the elongated high pressure housing 28, between the high pressure chamber 30 and the lower pressure chamber 32.

When the piston valve 56 moves from its loaded position of FIG. 1 to its discharge position of FIG. 2, the valve head 72 moves down below its valve seat 74 so as to open communication between high pressure chamber 30 and low pressure chamber 32, allowing the high pressure gases contained in the high pressure chamber 30 to be expelled out through the gas exhaust ports 34 of nose section 22.

High pressure passage 78 is formed in the sidewall of upper cylindrical section 26 of high pressure housing 28, and communicates at its upper end with internal passage 44 of connector collar 40 and at its lower end with high pressure chamber 30. At the point of communication of high pressure passage 78 with high pressure chamber 30, the enlarged upper portion of piston valve 56 is undercut so as to form an annular space 80 between the piston valve and its annular shoulder 82 which is located above the point of entry of the high pressure passage 78. A sliding seal 84 is formed between the smaller diameter portion of piston valve 56 and the high pressure housing 28, so that the effect of the pressure in annular space 80 beneath the shoulder 82 of the piston valve 56 is to urge the piston valve upwardly toward its position as illustrated in FIG. 1. Because the high pressure passage 78 is continuously in open communication with the high pressure of the gas supply conduit 16, there will always be a high pressure that tends to urge piston valve 56 to its upward position during the continuous operation of the pulse generator.

OPERATION

When the pulse wave generator (the gas expulsion tool) is to be used, the operator estimates the fracturing pressure at which the subterranean earth formation about the wellbore will fracture. This calculation will determine the pressure at which to operate the tool as well as some of the physical characteristics of the tool. A tool having the right dimensions will be selected for use at the wellbore sites. It is well known that the fracture gradient of most oil-bearing subterranean earth formations about a wellbore is approximately 0.7 psi per foot of depth. This is believed to be due to the fact that produceable oil bearing earth formations, such as porous rock, are mechanically similar, and will therefore have similar fracture gradients.

When the pulse wave generator 10 is moved downwardly into the well casing, it is desirable that it be in the production zone 14. Once in position, high pressure gas is communicated to the pulse wave generator through gas supply conduit 16. Typically, the pressure for optimum operation would be at or above 50% of the formation fracturing pressure. However, higher and lower gas supply pressures can be used, as may be available and desirable.

The line gas moves through the collar 40 and its strainer 42 and then moves in parallel directions, one direction being through the pilot passage 54 that extends along the length of the pilot valve and which charges internal piston valve chamber 58 and high pressure chamber 30 of housing 28. In the meantime, line pressure also communicates through high pressure passage 78 so as to bypass the pilot valve and to move beneath the annular shoulder 82 of piston valve 56. Thus, high pressure passage 78 tends to urge the piston valve 56 upwardly to maintain the piston valve in position as shown in FIG. 1.

In the meantime, as the high pressure chamber 30 continues to be progressively charged with line pressure, and the pressure within the high pressure chamber continues to increase, the increasing pressure eventually will exceed approximately 80% of the line pressure of gas supply conduit 16, so that the 80% pressure urges pilot valve 48 upwardly due to the larger effective pressure surface at the lower portion of the pilot valve.

When the pilot valve moves upwardly, it unseats itself from its valve seat 62 and its O-ring valve seat 64, which allows the high pressure to reach the upper end of piston valve 56. Since the lower end of the valve head 72 of piston valve 56 is in communication with the lower pressure of the well, the now higher pressure at the upper end of the piston valve abruptly forces piston valve 56 to surge downwardly through high pressure housing 28, so that its lower valve head 72 moves beyond its valve seat 74, to the position illustrated in FIG. 2. This allows the high pressure gas to surge downwardly from the high pressure chamber 30, past the seal 74 into the lower pressure chamber 32, and to surge outwardly through the gas exhaust ports 34 of nose section 22.

The surge of gas through the nose section 22 and through the openings 18 of the well casing 12 creates a shock wave inside the well casing, and through the openings 18 of the well casing out into the production zone 14, where the liquid and solid material surrounding the well casing is shocked, disrupted, and displaced, causing the exterior material to open up and permit more flow of liquid.

Once the piston valve has been moved to its open position as shown in FIG. 2 and the high pressure gas has been abruptly discharged, there is an absence of gas flow from the pulse wave generator so that the previous abrupt expansion of gases in the production zone will dissipate, so as to implode, which further tends to open up the production zone.

After the gas shock wave has been emitted, the continuous application of line pressure through high pressure passage 78 results in a lifting force being applied to the annular shoulder 82 of the piston valve 56, so that the piston valve is lifted from its open position of FIG. 2 back to its closed position of FIG. 1. In the meantime, the line pressure is applied to the upper end of pilot valve 48, urging pilot valve 48 from its upper, open position of FIG. 2 toward its lower, closed position of FIG. 1, where it registers with and closes against the upper end of piston valve 56. The system is then ready for its next cycle of operation.

The shape of the pulse of the gas "explosion" is important. The shape of the pulse determines the penetrating power of the pulse, and if the main frequency spectrum of the pulse is at or below 50 Hz, the wave generated by the gas explosion can travel for long distances through the earth with minimum attenuation. Further, it is important to note that this main frequency spectrum of the pulse is in the range of the natural frequencies of the materials which are plugging up the formation and impeding the oil flow. This desirable 50 Hz frequency spectrum is determined by controlling the duration of the pulse, which is believed should be greater than 20 milliseconds. However, if the rise time of the pressure pulse is excessively long, there is no "shock wave" effect, only an oscillatory wave, which would not provide as effective cleaning. For this reason, the system is designed to provide a maximum rise time for the pressure pulse to be less than 18 milliseconds and a minimum pulse duration of 20 milliseconds.

It should be understood the foregoing relates only to the preferred embodiments of the present invention, and that numerous changes and modifications may be made thereto without departing from the spirit and scope of the invention as set forth in the following claims.

I claim:

1. A pulse generator for emitting a series of high pressure gas pulses downhole in a well to remove obstructions to flow in the wellbore about a well casing comprising:

a housing for placement at the production zone of the well casing, said hosing having an elongated, substantially cylindrical outer surface and including:

a nose section having an internal chamber and defining a plurality of high pressure gas exhaust ports for emitting high pressure gas from its internal chamber outwardly into a well casing surrounding said housing at the production zone of the well casing;

an elongated high pressure housing having an elongated high pressure chamber having a nose end in fluid communication with said internal chamber of the nose section, a pilot end defining a pilot valve opening, and a piston valve seat at said nose end of the high pressure chamber;

an elongated piston valve positioned in said high pressure chamber of the high pressure housing and freely reciprocatable in said high pressure chamber;

a pilot valve having an internal piston chamber with a pilot valve opening and pilot valve seat at one end for engagement with said pilot valve and closed at its other end and including a valve head for engagement with said piston valve seat and sealing said high pressure chamber of the high pressure housing from said internal chamber of said nose section;

said piston valve further defining a plurality of gas ports for emitting high pressure gas from said internal piston chamber of the piston valve outwardly into said high pressure chamber of the high pressure housing when said piston valve head is moved away from said piston valve seat;

said pilot valve including an internal end portion for engagement with said pilot valve seat of the piston valve when said valve head is in sealed engagement with said piston valve seat at the nose end of the high pressure chamber, and an external end portion extending outwardly of said high pressure housing, said internal end portion of the pilot valve having a first effective pressure surface exposed to said elongated high pressure chamber, said external end portion of the pilot valve having a second effective pressure surface exposed to outside said elongated high pressure chamber which is smaller than said first effective pressure surface;

said pilot valve including a gas bleed passage extending therethrough for passing gas from the outside to the inside of said elongated high pressure chamber for charging said elongated high pressure chamber.

2. A method of stimulating the flow of liquid through subterranean earth formations to a wellbore in the earth comprising the steps of:

determining the level of liquid in the wellbore;

estimating the pressure at which most of the subterranean earth formation about the wellbore will fracture;

inserting a gas expulsion tool into a well casing which extends into the wellbore to the depth below the level of the liquid in the wellbore and to the depth of the earth formation to be stimulated;

expelling a surge of compressed gas from the gas expulsion tool in the well casing and through openings in the well casing and out beyond the wellbore at the depth of the earth formation to be stimulated at a pressure exceeding 50% of the estimated formation fracturing pressure.

3. The method of claim 2 and wherein the step of expelling a surge of compressed gas from the gas expulsion tool comprises:

expelling the gas at a rate which achieves the highest pressure surge from the expelled gas in the earth formation within 18 milliseconds.

4. The method of claim 3 and wherein the step of expelling a surge of compressed gas from the gas expulsion tool comprises:

expelling the gas with a pulse duration of at least 20 milliseconds.

5. The method of claim 3 and wherein the step of expelling a surge of compressed gas from the gas expulsion tool comprises:

expelling the gas at the subterranean earth formation at a pressure which exceeds the fracturing pressure of the formation.

6. The method of claim 3 and wherein the step of expelling a surge of compressed gas from the gas expulsion tool comprises:

expelling the gas in a series of expulsions at time intervals not less than the time required for the gas previously expelled to move away from the gas expulsion tool and be replaced by liquid under the influence of gravity.

* * * * *